US005289679A

United States Patent [19]

Yasuda

[11] Patent Number: 5,289,679

[45] Date of Patent: Mar. 1, 1994

[54] HYDRAULIC DRIVE SYSTEM WITH PRESSURE COMPENSATING VALVE

[75] Inventor: Gen Yasuda, Ibaraki, Japan

[73] Assignee: Hitachi Construction Machinery Co., Ltd., Tokyo, Japan

[21] Appl. No.: 956,493

[22] PCT Filed: May 8, 1992

[86] PCT No.: PCT/JP92/00589

§ 371 Date: Jan. 5, 1993

§ 102(e) Date: Jan. 5, 1993

[87] PCT Pub. No.: WO92/19821

PCT Pub. Date: Nov. 12, 1992

[30] Foreign Application Priority Data

May 9, 1991 [JP] Japan ..... 3-132175

[51] Int. Cl.[5] ..... F16D 31/00; F16D 33/00

[52] U.S. Cl. ..... 60/422; 60/452

[58] Field of Search ..... 60/420, 422, 445, 452

[56] References Cited

U.S. PATENT DOCUMENTS

| | | | |
|---|---|---|---|
| 5,056,312 | 10/1991 | Hirata et al. | 60/426 |
| 5,079,919 | 1/1992 | Nakamura et al. | 60/484 X |
| 5,083,430 | 1/1992 | Hirata et al. | 60/452 X |
| 5,134,853 | 8/1992 | Hirata et al. | 60/420 |
| 5,146,747 | 9/1992 | Sugiyama et al. | 60/452 |

FOREIGN PATENT DOCUMENTS

| | | |
|---|---|---|
| 2-125034 | 5/1990 | Japan . |
| 2-256902 | 10/1990 | Japan . |
| 2-275101 | 11/1990 | Japan . |
| WO9000683 | 1/1990 | PCT Int'l Appl. . |

*Primary Examiner*—Richard A. Bertsch
*Assistant Examiner*—John Ryznic
*Attorney, Agent, or Firm*—Fay, Sharpe, Beall, Fagan, Minnich & McKee

[57] ABSTRACT

A hydraulic drive system for a construction machine comprising a plurality of distribution compensating valves (7*a*, 7*b*) for controlling the respective differential pressures across the plurality of flow control valves (6*a*, 6*b*), the distribution compensating valves respectively having first pressure bearing chambers (52*a*, 52*b*) acting in a valve-closing direction, second pressure bearing chambers (53*a*, 53*b*) acting in a valve-opening direction, and third pressure bearing chambers (54*a*, 54*b*) acting in the valve-closing direction to reduce target values of differential pressures across a plurality of associated flow control valves (6*a*, 6*b*). The system further comprises a fourth pressure bearing chamber (55*a*, 55*b*) provided in at least one of the plurality of distribution compensating valves (7*a*, 7*b*) and subjected to a second control pressure ($P_{CT}$) for acting in the valve-opening direction to set a target value ($\Delta P_T$) of the differential pressure across the associated flow control valve (6*a*, 6*b*). This enables the target value of the differential pressure across the flow control valve to be freely changed whereby an allowable maximum flow rate passing through the flow control valve can be freely changed so that a maximum driving speed may be freely set dependent upon the capacity of a hydraulic actuator used and/or the forms of work to be carried out.

8 Claims, 6 Drawing Sheets

HYDRAULIC DRIVE SYSTEM WITH PRESSURE COMPENSATING VALVE

TECHNICAL FIELD

The present invention relates to a hydraulic drive system for construction machines, and more particularly to a hydraulic drive system for construction machines which includes a pressure compensating valve for controlling a differential pressure across a flow control valve to be held at a predetermined value.

BACKGROUND ART

As a conventional hydraulic drive system for construction machines such as hydraulic excavators, there is known a load sensing system for controlling a delivery rate of a hydraulic pump so that a delivery pressure of the hydraulic pump is held higher a fixed value than a maximum load pressure among a plurality of actuators. Generally, this system includes a plurality of flow control valves for controlling respective flow rates of a hydraulic fluid supplied from the hydraulic pump to the plurality of actuators, and pressure compensating valves, called distribution compensating valves, arranged upstream of the respective flow control valves for controlling differential pressures across the flow control valves. With the provision of the distribution compensating valves, when plural actuators are simultaneously driven in the combined operation, the hydraulic fluid is surely supplied to the actuator on the lower load side as well for the smooth combined operation.

W090/00683 (corresponding to U.S. Pat. No. 5,056,312) discloses one developed form of such a load sensing system. The disclosed system comprises a differential pressure sensor for detecting a differential pressure between the pump delivery pressure and the maximum load pressure, i.e., an LS differential pressure, and outputting a corresponding differential pressure signal, a memory for storing a plurality of data patterns which are associated with types of the actuators and used to individually compute set values of the distribution compensating valves, and a computing control unit for computing the set values dependent upon the differential pressure signal from the plurality of data patterns. In the combined operation in which plural actuators are simultaneously driven, by individually controlling the set values of the distribution compensating valves based on the above computed values, the hydraulic fluid can be not only supplied to the actuator on the lower load side as well, but also supplied to the actuators at distribution ratios suitable for their types, thereby improving operability even under a saturated condition in which the delivery rate of the hydraulic pump is insufficient.

In the above system, each of the distribution compensating valves comprises a first pressure bearing chamber subjected to a pressure upstream of the associated flow control valve for acting in a valve-closing direction, a second pressure bearing chamber subjected to a pressure downstream of the associated flow control valve for acting in a valve-opening direction, means for applying a certain control force in the valve-opening direction to set a target value of the differential pressure across the associated flow control valve, and a third pressure bearing chamber subjected to a control pressure from a solenoid proportional control valve for acting in the valve-closing direction to reduce the above differential pressure target value. The computing control unit computes a target reducing value for the differential pressure target value and outputs a corresponding signal to the solenoid proportional control valve which in turns produces the control pressure for a reduction of the differential pressure target value in an individual manner.

The above means for setting the differential pressure target value is usually a spring as shown in FIG. 1 of W090/00683. Also, instead of the spring, a pressure bearing chamber subjected to a certain pilot pressure is provide in FIG. 15 of W090/00683. Further, in FIG. 17 of W090/00683, the above third pressure bearing chamber acting in the valve-closing direction is omitted, and a pressure bearing chamber acting in the valve-opening direction is provided instead which can double as the third pressure bearing chamber. A control pressure introduced to that pressure bearing chamber is controlled so that the chamber may carry out both a function of the means for setting the differential pressure target value and a function of the third pressure bearing chamber.

DISCLOSURE OF THE INVENTION

However, the above-mentioned prior art suffers from the following problem.

In the prior art disclosed in W090/00683, the target differential pressure between the upstream side and the downstream side of the flow control valve is controlled in an individual manner by reducing the differential pressure target value set by the setting means of the distribution compensating valve, and the differential pressure target value is constant corresponding to the initial setting of the spring, for example. Therefore, a maximum of the differential pressure target value is also constant. Here, the maximum of the differential pressure target value specifies an allowable maximum flow rate passing through the flow control valve, meaning that if the maximum target differential pressure is constant, the allowable maximum flow rate passing through the flow control valve is constant, too.

Meanwhile, in construction machines such as hydraulic excavators, a hydraulic cylinder or motor used to constitute a hydraulic actuator has various magnitudes of capacity dependent upon the kinds of work to be carried out. Under these situations, in an attempt of providing the same driving speed at the same input amount of a control lever with the larger capacity of the hydraulic actuator, it is required to increase a flow rate of the hydraulic fluid supplied to the hydraulic actuator at that input amount. However, since the allowable maximum flow rate passing through the flow control valve is constant in the above-mentioned prior art, the supply flow rate corresponding to the same input amount of the control lever cannot increase and thus the driving speed at the same input amount of the control lever is so lowered that an operator is forced to have an awkward feeling. In addition, even if the input amount of the control lever is maximized, a sufficient driving speed cannot be obtained, making it difficult to perform the appropriate operation.

Furthermore, even with the capacity of the hydraulic actuator not changed, there is sometimes a desire of increasing, dependent upon the forms of work, the supply flow rate obtained when the control lever is maximally operated, thereby producing a larger maximum driving speed of the hydraulic actuator. In such a case, however, because the allowable maximum flow rate passing through the flow control valve is constant in the above-mentioned prior art, it is impossible to increase the flow rate of the hydraulic fluid supplied to the hydraulic actuator and thus to raise the maximum driving speed.

An object of the present invention is to provide a hydraulic drive system for a construction machine in which a target value of a differential pressure across a flow control valve can be freely changed to enable change in an allowable maximum flow rate passing through the flow control valve, so that a maximum driving speed may be freely set dependent upon capacity of a hydraulic actuator used and/or the forms of work to be carried out.

To achieve the above object, in accordance with the present invention, there is provided a hydraulic drive system for a construction machine comprising a hydraulic pump; a plurality of hydraulic actuators driven by a hydraulic fluid delivered from said hydraulic fluid; a plurality of flow control valves for controlling respective flow rates of the hydraulic fluid supplied from said hydraulic pump to said hydraulic actuators dependent upon input amounts of manipulation means; a plurality of distribution compensating valves controlling respective differential pressures across said plurality of flow control valves, said distribution compensating valves respectively having first pressure bearing chambers subjected to pressures upstream of the associated flow control valves for acting in a valve-closing direction, second pressure bearing chambers subjected to pressures downstream of the associated flow control valves for acting in a valve-opening direction, and third pressure bearing chambers subjected to first control pressures for acting in the valve-closing direction to reduce target values of the differential pressures across the associated flow control valves, differential pressure sensor means for detecting a differential pressure between a pressure of the hydraulic fluid delivered from said hydraulic pump and a maximum load pressure among said plurality of hydraulic actuators; first proportional control valve means for producing said first control pressures dependent upon first control currents; and first computing control means for calculating at least one target reducing value to reduce the target values of the differential pressures across said plurality of flow control valves based on a detected value of said differential pressure sensor means, and outputting the corresponding first control currents to said first proportional control valve means, wherein the hydraulic drive system further comprises (a) a fourth pressure bearing chamber provided in at least one of said plurality of distribution compensating valves and subjected to a second control pressure for acting in the valve-opening direction to set a target value of the differential pressure across the associated flow control valve; (b) second proportional control valve mean for producing said second control pressure dependent upon a second control current; (c) signal generating means for outputting a signal relating to the target value of the differential pressure across the associated flow control valve; and (d) second computing control means for calculating the target value of the differential pressure across said associated flow control valve dependent upon the signal from said signal generating means, and outputting the corresponding second control current to said second proportional control valve means.

With the present invention thus constructed, when the hydraulic actuator has the standard capacity, for example, the signal generating means outputs a signal indicating that fact and, in response to this signal, the second computing control means calculates a normal target value as the target value of the differential pressure across the associated flow control valve and outputs the corresponding second control current to the second proportional control valve means. The second proportional control valve means produces the second control pressure dependent upon the second control current, and the fourth pressure bearing chamber receives the second control pressure to set the normal target value as the target value of the differential pressure across the flow control valve. On the other hand, when the hydraulic actuator is replaced by another actuator of larger capacity, the signal generating means outputs a signal indicating that fact and, in response to this signal, the second computing control means calculates a value larger than the normal target value as the target value of the differential pressure across the associated flow control valve and outputs the corresponding second control current to the second proportional control valve means. The second proportional control valve means produces the second control pressure dependent upon the second control current, and the fourth pressure bearing chamber receives the second control pressure to set a target value larger than the normal one as the target value of the differential pressure across the flow control valve. As a result, when the hydraulic actuator is at the standard capacity, the distribution compensating valve sets the allowable maximum flow rate passing through the flow control valve to a standard maximum flow rate, and when the hydraulic actuator is at the capacity larger than standard, it sets the allowable maximum flow rate passing through the flow control valve to a flow rate larger than the standard maximum flow rate. Accordingly, the hydraulic fluid can be supplied at a flow rate appropriate for the capacity of each hydraulic actuator used and a maximum driving speed of the actuator can be freely set.

In the above hydraulic drive system, preferably, said signal generating means includes means for setting the type relating to capacity of the hydraulic actuator associated with the distribution compensating valve having said fourth pressure bearing chamber, and said second computing control means calculates said differential pressure target value dependent upon the signal from said setting means.

Said signal generating means may include operation sensor means for detecting an operation state of the flow control valve associated with the distribution compensating valve having said fourth pressure bearing chamber, and said second computing control means may calculate said differential pressure target value from a detected value of said operation sensor means.

Also, said signal generating means may include means for setting the type relating to capacity of the hydraulic actuator associated with the distribution compensating valve having said fourth pressure bearing chamber, and operation sensor means for detecting an operation state of the flow control valve associated with the distribution compensating valve, and said second computing control means may calculate said differential pressure target value dependent upon a signal from said setting means and a detected value of said operation sensor means.

In the above hydraulic drive system, preferably, said fourth pressure bearing chamber is provided in each of said plurality of distribution compensating valves, and said second proportional control valve means includes a common proportional control valve connected to the respective fourth pressure bearing chambers of said plurality of distribution compensating valves.

Said fourth pressure bearing chamber may be provided in each of said plurality of distribution compensating valves, and said second proportional control valve means may include a plurality of proportional control valves individually connected to the respective fourth pressure bearing chambers of said plurality of distribution compensating valves.

In the above hydraulic drive system, preferably, said second computing control means includes means for storing at least two target values for each of the differential pressures across said associated flow control valves including normal target values and target values larger than said normal target values, means for selecting one of said two target values dependent upon the signal from said signal generating means, and means for outputting said second control current dependent upon the selected target value.

Furthermore, said second computing control means may include means for storing an initial value for the target values of the differential pressures across said associated flow control valves and at least two different modification values to be added to said initial value, means for selecting one of said two modification values dependent upon the signal from said signal generating means and adding the selected modification value to said initial value to calculate said target value, and means for outputting said second control current dependent upon the calculated target value.

BEST MODE FOR CARRYING OUT THE INVENTION

Hereinafter, the present invention will be described with reference to illustrated embodiments. In the illustrated embodiments, the present invention is applied to a hydraulic drive system for a hydraulic excavator.

To begin with, a first embodiment of the present invention will be explained by referring to FIGS. 1 to 6.

Figure 1:
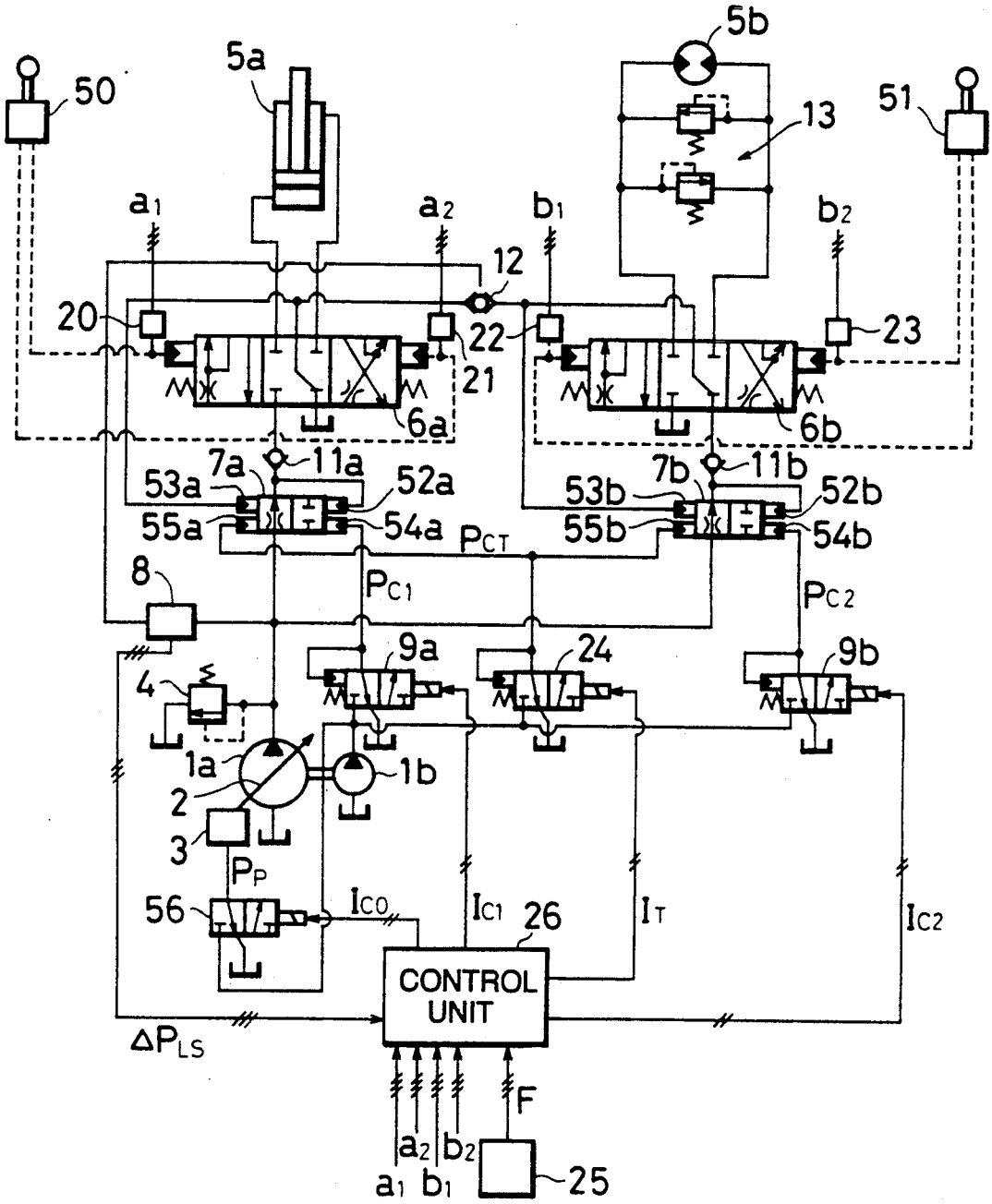
FIG. 1 is a block diagram of a hydraulic drive system for a construction machine according to a first embodiment of the present invention.

In FIG. 1, a hydraulic drive system of this embodiment comprises a main hydraulic pump 1*a* of variable displacement type provided with a displacement volume varying mechanism 2, a pilot pump 1*b*, a pump control servo mechanism 3 for driving the displacement volume varying mechanism 2, a relief valve 4 for specifying a maximum pressure of a hydraulic fluid delivered from the main hydraulic pump Ia, a hydraulic cylinder 5*a*, a hydraulic motor 5*b*, a first flow control valve 6*a* for controlling a flow rate and a flowing direction of the hydraulic fluid supplied to the hydraulic cylinder 5*a* dependent upon an input amount and an input direction of a control lever unit 50, to thereby control driving of the hydraulic cylinder 5*a*, a second flow control valve 6*b* for controlling a flow rate and a flowing direction of the hydraulic fluid supplied to the hydraulic motor 5*b* dependent upon an input amount and an input direction of a control lever unit 51, to thereby control driving of the hydraulic motor 5*b*, and first and second pressure compensating valves, i.e., distribution compensating valves, for operating so that differential pressures across the flow control valves 6*a*, 6*b* are held at respective specified values.

The first distribution compensating valve 7*a* has a first pressure bearing chamber 52*a* subjected to a pressure upstream of the first flow control valve 6*a* for acting in a valve-closing direction, a second pressure bearing chamber 53*a* subjected to a pressure downstream of the first flow control valve 6*a* for acting in a valve-opening direction, a third pressure bearing chamber 54*a* subjected to a first control pressure $P_{C1}$ for acting in the valve-closing direction to reduce a target value of the differential pressure across the first flow control valve 6*a*, and a fourth pressure bearing chamber 55*a* subjected to a second control pressure $P_{CT}$ for acting in the valve-opening direction to set the target value of the differential pressure across the first flow control valve 6*a*. The second distribution compensating valve 7*b* has a first pressure bearing chamber 52*b* subjected to a pressure upstream of the second flow control valve 6*b* for acting in a valve-closing direction, a second pressure bearing chamber 53*b* subjected to a pressure downstream of the second flow control valve 6*b* for acting in a valve-opening direction, a third pressure bearing chamber 54*b* subjected to a first control pressure $P_{C2}$ for acting in the valve-closing direction to reduce a target value of the differential pressure across the second flow control valve 6*b*, and a fourth pressure bearing chamber 55*b* subjected to the second control pressure $P_{CT}$ for acting in the valve-opening direction to set the target value of the differential pressure across the second flow control valve 6*b*.

The hydraulic drive system of this embodiment also comprises a differential pressure sensor 8 for detecting a differential pressure between a delivery pressure from the main hydraulic pump 1*a* and a maximum one of load pressures of the hydraulic cylinder 5*a* and the hydraulic motor and outputting a differential pressure signal $\Delta P_{LS}$, a first solenoid proportional control valve 56 for producing a pump control pressure $P_P$ introduced to the pump control servo mechanism 3, a second solenoid proportional control valve 9*a* for producing the first control pressure $P_{C1}$ introduced to the third pressure bearing chamber 54*a* of the first distribution compensating valve 7*a* acting in the valve-closing direction, a third solenoid proportional control valve 9*b* for producing the first control pressure $P_{C2}$ introduced to the third pressure bearing chamber 54*b* of the second distribution compensating valve 7*b* acting in the valve-closing direction, operation sensors 20, 21 for sensing pilot pressures introduced from the control lever, unit 50 to the first flow control valve 6*a* to detect an operation state of the first flow control valve 6a, i.e., whether or not the hydraulic cylinder 5a is driven, and respectively outputting operation signals $a_1$, $a_2$, operation sensors 22, 23 for sensing pilot pressures introduced from the control lever unit 51 to the second flow control valve 6b to detect an operation state of the second flow control valve 6b, i.e., whether or not the hydraulic cylinder 5b is driven, and respectively outputting operation signals $b_1$, $b_2$, a fourth solenoid proportional control valve 24 for producing the second control pressure $P_{CT}$ introduced to the fourth pressure bearing chamber 55a, 55b of the first and second distribution compensating valves 7a, 7b both acting in the valve-opening direction, and an actuator type setter 25 for setting the type related to capacity of the hydraulic actuator used and outputting an actuator type signal F. The actuator type signal F is a signal indicating whether the capacity set by the actuator type setter 25 is standard or other capacity.

The hydraulic drive system of this embodiment further comprises a control unit 26 for taking in the differential pressure signal $\Delta P_{LS}$ from the differential pressure sensor 8, the operation signals $a_1$, $a_2$, $b_1$, $b_2$ from the operation sensors 20, 21, 22, 23, and the actuator type signal F from the actuator type setter 25, executing predetermined operations, and outputting control currents $I_{C0}$, $I_{C1}$, $I_{C2}$, $I_T$ to respectively drive the first to fourth solenoid proportional control valves 56, 9a, 9b, 24.

Additionally, denoted by 11a, 11b in the drawing are check valves, 12 is a shuttle valve for selecting the maximum load pressure, and 13 is a crossover relief valve.

Figure 2:
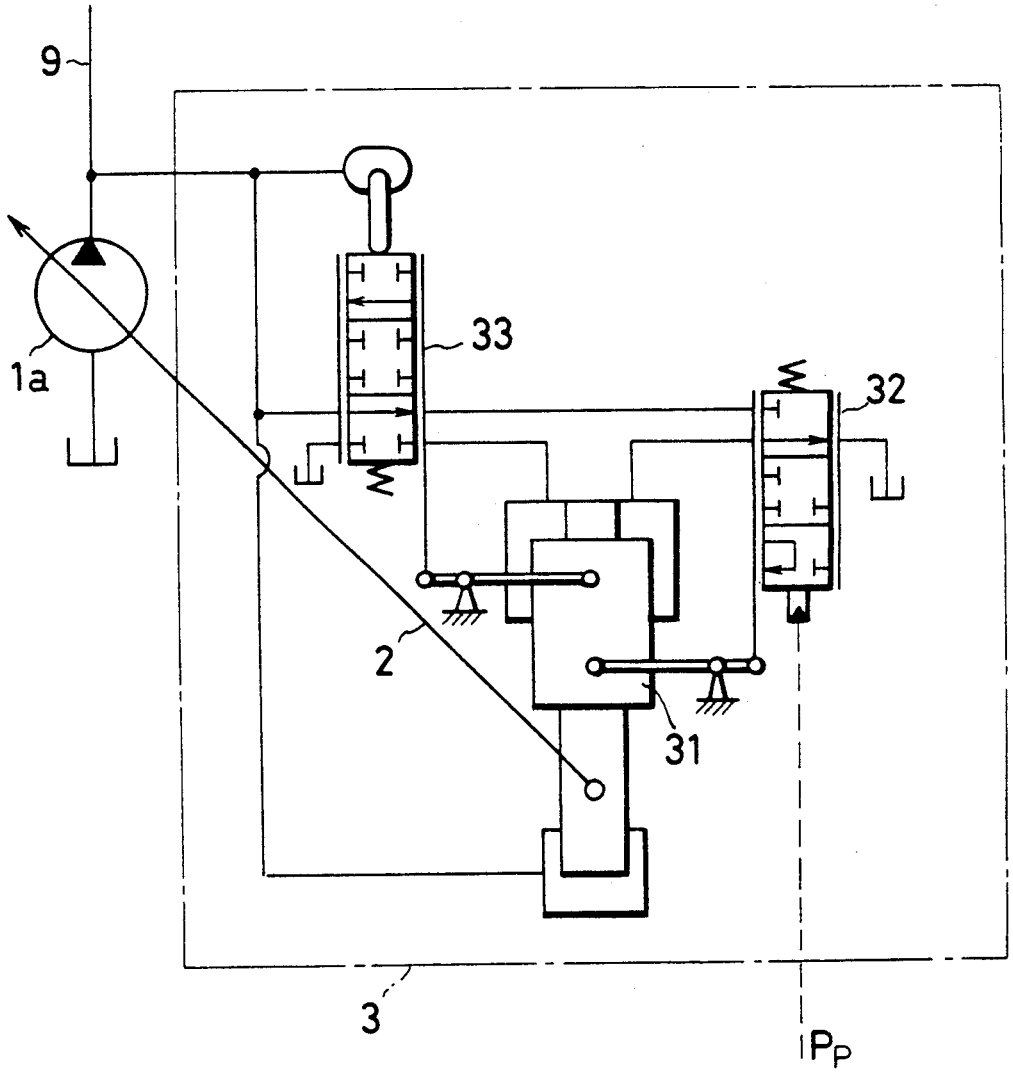
FIG. 2 is a circuit diagram showing details of a servo mechanism for a hydraulic pump shown in FIG. 1.

The pump control servo mechanism 3 comprises, as shown in FIG. 2, a piston/cylinder unit 31 for driving the displacement volume varying mechanism 3 of the hydraulic pump 1a, a first servo valve 32 responsive to the pump control pressure PP from the first solenoid proportional control valve 56 for regulating a flow rate of the hydraulic fluid supplied to the piston/cylinder unit 31, to thereby control the displacement volume of the hydraulic pump 1a, and an input torque limiting second servo valve 33 responsive to the pump delivery pressure for regulating the flow rate of the hydraulic fluid supplied to the piston/cylinder unit 31, to thereby control the displacement volume of the hydraulic pump 1a.

Figure 3:
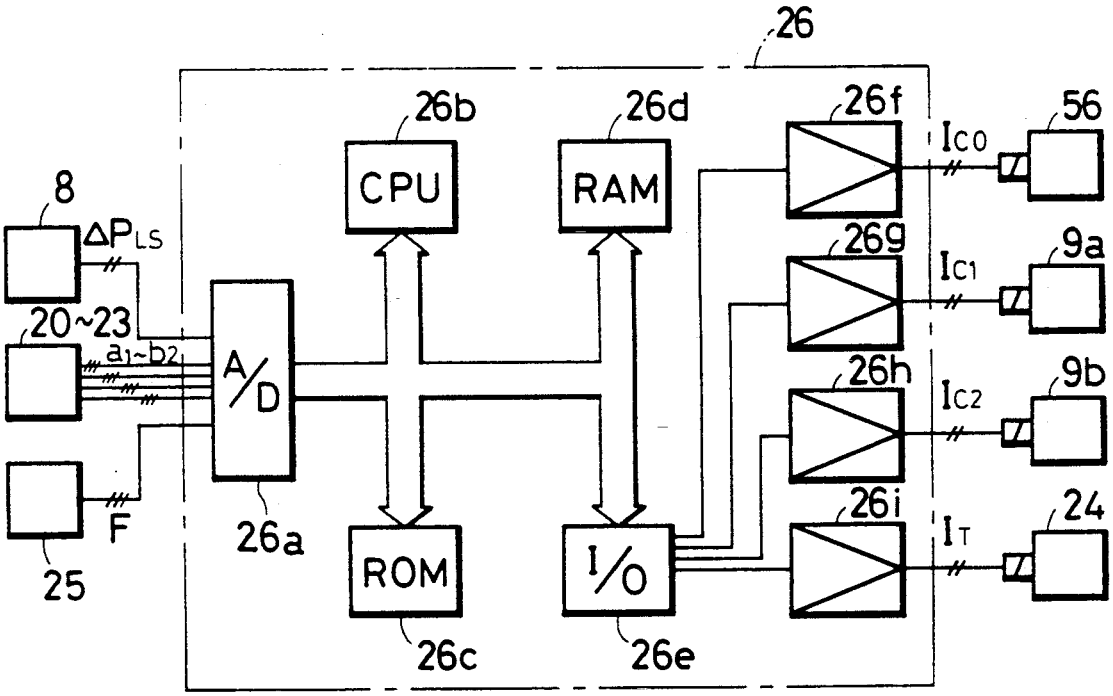
FIG. 3 is a block diagram showing a hardware configuration of a control unit shown in FIG. 1.

The control unit 26 is constituted by a microcomputer and comprises, as shown in FIG. 3, an A/D converter 26a for receiving the differential pressure signal $\Delta P_{LS}$ from the differential pressure sensor 8, the operation signals $a_1$, $a_2$, $b_1$, $b_2$ from the operation sensors 20, 21, 22, 23, and the actuator type signal F from the actuator type setter 25, and converting these signals into respective digital signals, a central processing unit (CPU) 26b for executing predetermined arithmetic operations, a read only memory (ROM) 26c for storing a program to execute the arithmetic operations, a random access memory (RAM) 26d for temporarily storing numeral values in the course of the arithmetic operations, an I/O interface 26e for outputting analog control signals, and amplifiers 26f, 26g, 26h, 26i respectively connected to the first to fourth solenoid proportional control valves 56, 9a, 9b, 24 for outputting the control currents $I_{C0}$, $I_{C1}$, $I_{C2}$, $I_T$.

An outline of computing functions effected by the control unit 26 will now be described. First, based on the differential pressure signal $\Delta P_{LS}$ from the differential pressure sensor 8, the control unit 26 calculates a target displacement volume of the hydraulic pump la adapted for holding the differential pressure between the pump delivery pressure and the maximum load pressure constant, and outputs the control current $I_{C0}$ corresponding to the calculated target displacement volume. As a result, the delivery rate of the hydraulic pump 1a is controlled so that the delivery pressure of the hydraulic pump 1a is held higher a fixed value than the maximum load pressure. Details of this process is described in, for example, the above-cited W090/00683.

Also, based on the differential pressure signal $\Delta P_{LS}$ from the differential pressure sensor 8, the control unit 26 individually calculates target reducing values $\Delta P_{C1}$, $\Delta P_{C2}$ to reduce the respective target values of the differential pressures across the first and second flow rate control valve 6a, 6b and outputs the control currents $I_{C1}$, $I_{C2}$ corresponding to the calculated target reducing values $\Delta P_{C1}$, $\Delta P_{C2}$ to the second and third solenoid proportional control valves 9a, 9b, respectively.

Then, the control unit 26 determines the operation states of the hydraulic cylinder 5a and the hydraulic motor 5b based on the operation signals $a_1$, $a_2$, $b_1$, $b_2$ from the operation sensors 20, 21, 22, 23, calculates a first target value $\Delta P_{T0}$ of both the differential pressures across the first and second flow rate control valve 6a, 6b from the determined operation states of the hydraulic cylinder 5a and the hydraulic motor 5b, determines the types of the hydraulic actuators 5a, 5b based on the actuator type signal F from the setter 25, modifies the first target value $\Delta P_{T0}$ dependent upon the determined actuator types to calculate a second target value $\Delta P_T$, and finally outputs the control current $I_T$ corresponding to the calculated second target value $\Delta P_T$ to the fourth solenoid proportional control valve 24.

The operating procedures carried out by the control unit 26 until outputting the control currents $I_{C1}$, $I_{C2}$ and the control current $I_T$ will now be described in detail with reference to a flowchart shown in FIG. 4.

Figure 5:
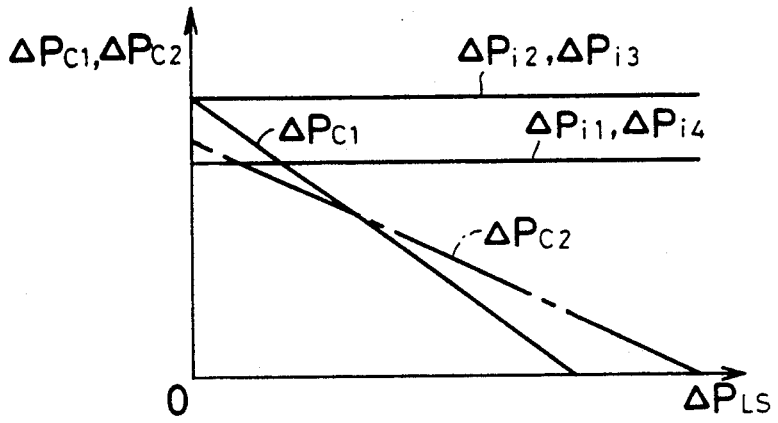
FIG. 5 is a graph showing the relationship of a control pressure introduced to a distribution compensating valve with respect to a differential pressure between a pump delivery pressure and a maximum load pressure.

After initializing the microcomputer (step 201), the control unit 26 first reads the differential pressure signal $\Delta P_{LS}$ from the differential pressure sensor 8, the operation signals $a_1$, $a_2$, $b_1$, $b_2$ from the operation sensors 20, 21, 22, 23, and the actuator type signal F from the actuator type setter 25 (step 202). Subsequently, using the first computing function, the control unit 26 individually derives the target reducing values $\Delta P_{C1}$, $\Delta P_{C2}$ to reduce the respective target values of the differential pressures across the first and second flow rate control valve 6a, 6b from the differential pressure signal $\Delta P_{LS}$ based on predetermined functional relationships. FIG. 5 shows one example of the predetermined functional relationships, in which the axis of abscissas represents the differential pressure signal $\Delta P_{LS}$ and the axis of ordinate represents the target reducing values $\Delta P_{C1}$, $\Delta P_{C2}$. Exemplarily illustrated characteristics of $\Delta P_{C1}$, $\Delta P_{C2}$ can be optionally set in view of characteristics in the combined operation of the hydraulic cylinder 5a and the hydraulic motor 5b. The functions have such a relationship that as the value of the differential pressure signal $\Delta P_{LS}$ increases, the target reducing values $\Delta P_{C1}$, $\Delta P_{C2}$ decreases. In other words, when the differential pressure between the pump delivery pressure and the maximum load pressure is reduced, the target reducing values $\Delta P_{C1}$, $\Delta P_{C2}$ are increased to make smaller the target values of the differential pressures across the first and second flow control valves 6a, 6b, thereby lessening the allowable maximum flow (step 203).

Subsequently, the control unit 26 determines the operation states of the hydraulic cylinder 5a and the hydraulic motor 5b from the operation signals $a_1$, $a_2$, $b_1$, $b_2$ using the second computing function and, based on the determined results, and calculates the first target value $\Delta P_{T0}$ as an initial value of the differential pressure target value $\Delta P_T$ set by both the fourth pressure bearing chambers 55a, 55b. More specifically, if the operation signals meet $a_1 > a_{11}$ or $a_2 > a_{22}$ and $b_1 > b_{11}$ or $b_2 > b_{22}$ (steps 204, 205), then the first target value $\Delta P_{T0}$ is set equal to $\Delta P_{i1}$ (step 207) because the hydraulic cylinder 5a and the hydraulic motor 5b are both driven. If the operation signals meet $a_1 > a_{11}$ or $a_2 > a_{22}$ but not $b_1 > b_{11}$ or $b_2 > b_{22}$ (steps 204, 205), then the first target value $\Delta P_{T0}$ is set equal to $\Delta P_{i2}$ (step 208) because only the hydraulic cylinder 5a is driven. If the operation signals meet not $a_1 > a_{11}$ or $a_2 > a_{22}$ but $b_1 > b_{11}$ or $b_2 > b_{22}$ (steps 204, 206), then the first target value $\Delta P_{T0}$ is set equal to $\Delta P_{i3}$ (step 209) because only the hydraulic motor 5b is driven. If the operation signals meet neither $a_1 > a_{11}$ or $a_2 > a_{22}$ nor $b_1 > b_{11}$ or $b_2 > b_{22}$ (steps 204, 206), then the first target value $\Delta P_{T0}$ is set equal to $\Delta P_{i4}$ (step 210) because the hydraulic cylinder 5a and the hydraulic motor 5b are not both driven. Note that $a_{11}$, $a_{22}$, $b_{11}$, $b_{22}$ are values slightly greater than respective dead zones of the control lever units 50, 51. Also, $\Delta P_{i1}$, $\Delta P_{i2}$, $\Delta P_{i3}$, $\Delta P_{i4}$ are determined from the functional relationships shown in FIG. 5. More specifically, $\Delta P_{i1} = \Delta P_{i4}$ and $\Delta P_{i2} = \Delta P_{i3}$ hold. $\Delta P_{i1}$, $\Delta P_{i4}$ take a value for a normal mode in which the target values of the differential pressures across the first and second flow control valves 6a, 6b are set to a normal level. $\Delta P_{i2}$, $\Delta P_{i3}$ take a value for a high-speed mode in which the target values of the differential pressures across the first and second flow control valves 6a, 6b are set to a relatively large level.

After that, the control unit 26 determines the types of the hydraulic actuators 5a, 5b from the actuator type signal F using the fourth computing function, and then modifies the first target value $\Delta P_{T0}$ dependent upon the determined types of the hydraulic actuators 5a, 5b to calculate the second target value $\Delta P_T$ using the fifth computing function. More specifically, if it is determined from detection of the actuator type signal F that the hydraulic cylinder 5a and the hydraulic motor 5b are both at the standard capacities (steps 211, 212), the second target value $\Delta P_T$ is set equal to $\Delta P_{T0} + P_{S1}$ (step 214). If it is determined that the hydraulic cylinder 5a is at the standard capacity and the hydraulic motor 5b is not at the standard capacity (steps 211, 212), the second target value $\Delta P_T$ is set equal to $\Delta P_{TO} + P_{S2}$ (step 215). If it is determined that the hydraulic cylinder 5a is not at the standard capacity and the hydraulic motor 5b is at the standard capacity (steps 211, 213), the second target value $\Delta P_T$ is set equal to $\Delta P_{T0} + P_{S2}$ (step 215). If it is determined that the hydraulic cylinder 5a and the hydraulic motor 5b are both not at the standard capacities (steps 211, 213), the second target value $\Delta P_T$ is set equal to $\Delta P_{T0} + P_{S4}$ (step 217). Note that $P_{S1}$ to $P_{S4}$ are modification values determined dependent upon the type signal and are related to meet at least $P_{S1} < P_{S2}$ and $P_{S3} < P_{S4}$.

Figure 6:
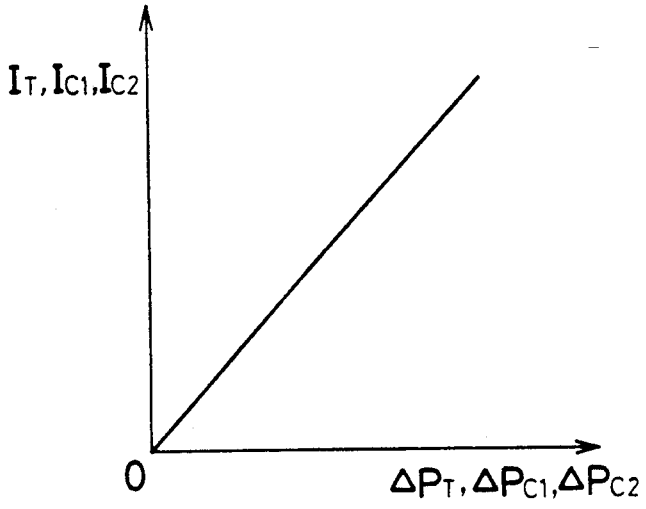
FIG. 6 is a graph showing the functional relationship of an opening-side target value and a closing-side target value of the distribution compensating valve with respect to a control current value when an opening-side control valve is driven and a control current value when a closing-side control valve is driven.

Finally, based on the functional relationship shown in FIG. 6, the control unit 26 outputs the control currents $I_{T,\ IC1}$, $I_{C2}$ dependent upon the above second target value $\Delta P_T$ and the aforesaid target reducing values $\Delta P_{C1,\ \Delta PC2}$. In FIG. 6, the axis of abscissas represents the control pressures $\Delta P_T$, $\Delta P_{C1}$, $\Delta P_{C2}$ and the axis of ordinate represents the control currents $I_T$, $I_{C1}$, $I_{C2}$. The illustrated function has such a relationship that as the control pressures $\Delta P_T$, $\Delta P_{C1}$, $\Delta P_{C2}$ rises, the control currents $I_T$, $I_{C1}$, $I_{C2}$ being thus outputted (step 218), the solenoid proportional control valves 9a, 9b, 24 are driven so that the first and second distribution compensating valves 7a, 7b are controlled to assume predetermined positions, followed by returning to the step 202.

In this embodiment constructed as mentioned above, when the first flow control valve 6a and/or the second flow control valve 6b is operated through the control lever unit 50 and/or the control lever unit 51, the hydraulic fluid delivered from the main hydraulic pump 1a is supplied to the hydraulic cylinder 5a and/or the hydraulic motor 5b through the first flow control valve 6a and/or the second flow control valve 6b. At this time, the differential pressures across the first flow control valve 6a and/or the second flow control valve 6b are controlled to become equal to respective target valves set by the third pressure bearing chambers 54a, 54b and the fourth pressure bearing chambers 55a, 55b of the first and second distribution compensating valves 7a, 7b. This process will be explained below.

Now, when the load pressure of the hydraulic motor 5b is raised dependent upon the form of work during the sole operation thereof, for example, the differential pressure across the second flow control valve 6b goes on to lower, but that load pressure is transmitted to the second pressure bearing chamber 53b of the second distribution compensating valve 7b acting in the valve-opening direction, whereby the opening of the second distribution compensating valve 7b is increased. At the same time, the differential pressure between the delivery pressure of the main hydraulic pump 1a and the maximum load pressure also goes on to lower, but this lowering of the difference pressure is detected as the differential pressure signal $\Delta P_{LS}$ by the differential pressure sensor 8. As a result, the control unit 26 drives the first solenoid proportional control valve 56 and the pump control servo mechanism 3 by the control current $I_{CO}$ to increase the delivery rate of the hydraulic pump 1a. With this operation, the pressure of the hydraulic fluid supplied to the second flow control valve 6b is raised so that the differential pressure across the second flow control valve 6b is held constant and the driving force of the hydraulic motor 5b is increased.

On the other hand, when the amount of the hydraulic fluid supplied from the hydraulic pump 1a is insufficient, i.e., when the pump delivery rate is saturated, during the combined operation of the hydraulic cylinder 5a and the hydraulic motor 5b, most of the hydraulic fluid would be supplied to the actuator on the lower pressure side and the combined operation would not be achieved if such a saturation is left as it is. In this case, the control unit 26 calculates the target reducing values $\Delta P_{C1}$, $\Delta P_{C2}$ in the step 203 shown in FIG. 4, and outputs the corresponding control currents $I_{C1}$, $I_{C2}$ to the second and third solenoid proportional control valves 9a, 9b in the step 218. These control valves 9a, 9b supply the first control pressures $P_{C1}$, $P_{C2}$ to the third pressure bearing chambers 54a, 54b of the distribution compensating valves 7a, 7b for urging the distribution compensating valves 7a, 7b in the valve-closing direction, respectively. As a result, the target values of the differential pressures across the flow control valves 6a, 6b set by the fourth pressure bearing chambers 55a, 55b of the distribution compensating valves 7a, 7b are reduced in an individual manner to eliminate the above saturated condition during the combined operation, making it possible to surely drive both the actuators simultaneously driven and give those actuators with a suitable distribution ratio dependent upon their types for the improved operability. Details of that process is described in the above-cited W090/00683.

Figure 4:
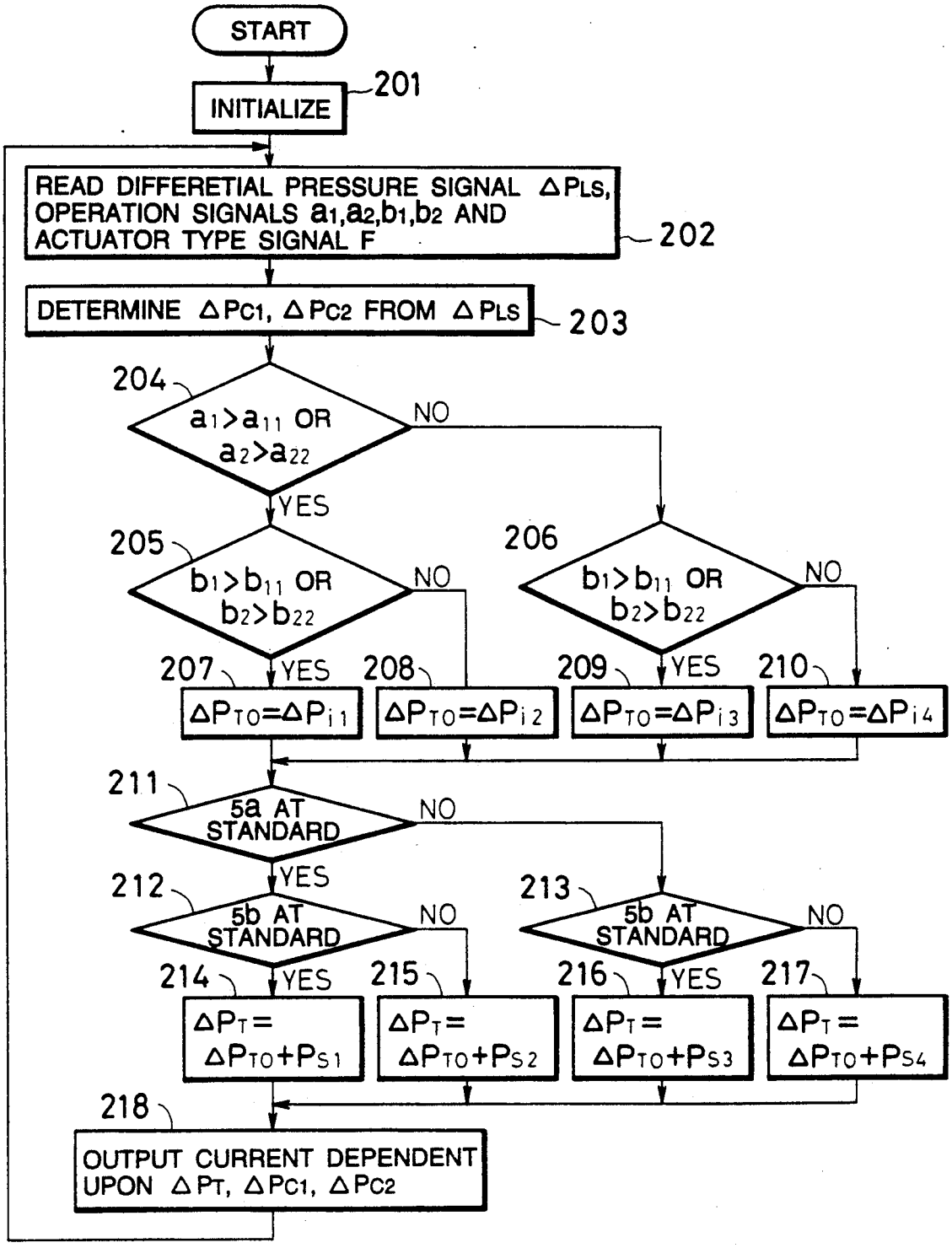
FIG. 4 is a flowchart for explaining functions of the control unit shown in FIG. 1.

Further, during the combined operation of the hydraulic cylinder 5a and the hydraulic motor 5b, the control unit 26 determines in the steps 204, 205 shown in FIG. 4 that the operation signals meet $a_1 > a_{11}$ or $a_2 > a_{22}$ and $b_1 > b_{11}$ or $b_2 > b_{22}$, and sets the first target value $\Delta P_{T0}$ to the normal value $\Delta P_{i1}$ in the step 207. Therefore, the second target value $\Delta P_T$ is determined with the normal value $\Delta P_{i1}$ being as an initial value in the steps 214 to 217, and the corresponding control current $I_T$ is outputted to the fourth solenoid proportional control valve 24 in the step 218. As a result, the target values of the differential pressures across the flow control valves 6a, 6b set by the fourth pressure bearing chambers 55a, 55b of the distribution compensating valves 7a, 7b become normal values and the normal allowable maximum flow rates passing through the flow control valves are obtained corresponding to those target values as explained above.

Meanwhile, when the hydraulic cylinder 5a or the hydraulic motor 5b is solely driven, the control unit 26 determines in the steps 204 to 206 shown in FIG. 4 that the operation signals meet $a_1 > a_{11}$ or $a_2 > a_{22}$ but not $b_1 > b_{11}$ or $b_2 > b_{22}$, or not $a_1 > a_{11}$ or $a_2 > a_{22}$ but $b_1 > b_{11}$ or $b_2 > b_{22}$, and sets the first target value $\Delta P_{T0}$ to the value $\Delta P_{i2}$ or $\Delta P_{i3}$ larger than normal in the step 208 or 209. Therefore, the second target value $\Delta P_T$ is determined with that value $\Delta P_{i2}$ or $\Delta P_{i3}$ larger than normal being as an initial value in the steps 214 to 217, and the corresponding control current $I_T$ is outputted to the fourth solenoid proportional control valve 24 in the step 218. As a result, the target values of the differential pressures across the flow control valves 6a, 6b set by the fourth pressure bearing chambers 55a, 55b of the distribution compensating valves 7a, 7b become values larger than normal and the corresponding allowable maximum flow rates passing through the flow control valves are modified to larger values. By so modifying the allowable maximum passing flow rate to become larger, the supply flow rate corresponding to the same input amount of the control lever unit is increased when one actuator is solely driven, so that the driving speed of the actuator is increased for more efficient operations.

Moreover, when both the hydraulic cylinder 5a and the hydraulic motor 5b have the standard capacities, the actuator type signal F for setting the hydraulic cylinder 5a and the hydraulic motor 5b to the standard capacities is outputted from the actuator type setter 25 upon the operator setting the actuator type setter 25. The control unit 26 determines from the actuator type signal F in the steps 211, 212 shown in FIG. 4 that the hydraulic cylinder 5a and the hydraulic motor 5b are both at the standard capacities, sets the second target value $\Delta P_T$ equal to $\Delta P_{T0} + P_{S1}$ in the step 214, and then outputs the corresponding control current $I_T$ to the fourth solenoid proportional control valve 24 in the step 218. As a result, the target values of the differential pressures across the flow control valves 6a, 6b set by the fourth pressure bearing chambers 55a, 55b of the distribution compensating valves 7a, 7b become standard values and the allowable maximum flow rates passing through the first and second flow control valves 6a, 6b also become standard values.

In addition, when one of the hydraulic cylinder 5a and the hydraulic motor 5b is replaced by another actuator having the capacity larger than standard, the actuator type signal F for setting one of the hydraulic cylinder 5a and the hydraulic motor 5b to the capacity other than standard is outputted from the actuator type setter 25 upon the operator setting the actuator type setter 25. The control unit 26 determines from the actuator type signal F in the steps 211, 212 or 211, 213 shown in FIG. 4 that one of the hydraulic cylinder 5a and the hydraulic motor 5b is at the capacity other than standard, sets the second target value $\Delta P_T$ equal to $\Delta P_{T0} + P_{S2}$ or $\Delta P_{T0} + P_{S3}$ in the step 215 or 216, and then outputs the corresponding control current $I_T$ to the fourth solenoid proportional control valve 24 in the step 218. As a result, the target values of the differential pressures across the flow control valves 6a, 6b set by the fourth pressure bearing chambers 55a, 55b of the distribution compensating valves 7a, 7b become values larger than those in the case of $\Delta P_T = \Delta P_{T0} + P_{S1}$ and the allowable maximum flow rates passing through the first and second flow control valves 6a, 6b are also modified to larger values. In other words, the supply flow rate corresponding to the same input amount of the control lever unit is increased so that the driving speed at the same input amount of the control lever unit of the actuator is slightly increased for the actuator of the standard capacity and slightly decreased for the actuator of the capacity other than standard. It is thus possible to lessen an awkward feeling perceived by the operator and improve the operability.

When the hydraulic cylinder 5a and the hydraulic motor 5b are both replaced by other actuators having the capacities larger than standard, the actuator type signal F for setting both the hydraulic cylinder 5a and the hydraulic motor 5b to the capacities other than standard is outputted from the actuator type setter 25 upon the operator setting the actuator type setter 25. The control unit 26 determines from the actuator type signal F in the steps 211, 213 shown in FIG. 4 that the hydraulic cylinder 5a and the hydraulic motor 5b are both at the capacities other than standard, sets the second target value $\Delta P_T$ equal to $\Delta P_{i0} = P_{S4}$ in the step 217, and then outputs the corresponding control current IT to the fourth solenoid proportional control valve 24 in the step 218. As a result, the target values of the differential pressures across the flow control valves 6a, 6b set by the fourth pressure bearing chambers 55a, 55b of the distribution compensating valves 7a, 7b become values still larger than those in the case of $\Delta P_T + \Delta P_{T0} + P_{S1}$ and the allowable maximum flow rates passing through the first and second flow control valves 6a, 6b are also modified to still larger values. In other words, the supply flow rate corresponding to the same input amount of the control lever unit is further increased so that the driving speed at the same input amount of the control lever unit of the actuator is not lowered while making the operator less subjected to an awkward feeling. Also, the sufficient driving speed can be obtained by maximizing the input amount of the control lever unit, which enables operations to be performed in an appropriate manner.

With this embodiment, as previously explained, since the fourth pressure bearing chambers 55a, 55b acting in the valve-opening direction are provided in the first and second distribution compensating valves 7a, 7b, respectively, and the target values of the differential pressures across the first and second flow control valves 6a, 6b set by the fourth pressure bearing chambers 55*a*, 55*b* are calculated by the control unit 26 dependent on the operation amounts and types of the respective hydraulic actuators, the allowable maximum flow rates passing through the flow control valves 6*a*, 6*b* can be modified dependent on the operation states and capacity types of the hydraulic actuators and, therefore, the maximum driving speeds of the actuators can be freely set. Consequently, even when the hydraulic actuator is replaced by another one of the capacity other than standard, for example, the operator can perform operations with the same feeling as that in the case of using the hydraulic actuator of the standard capacity, and the superior operability can be obtained without a reduction of the maximum driving speed.

Figure 7:
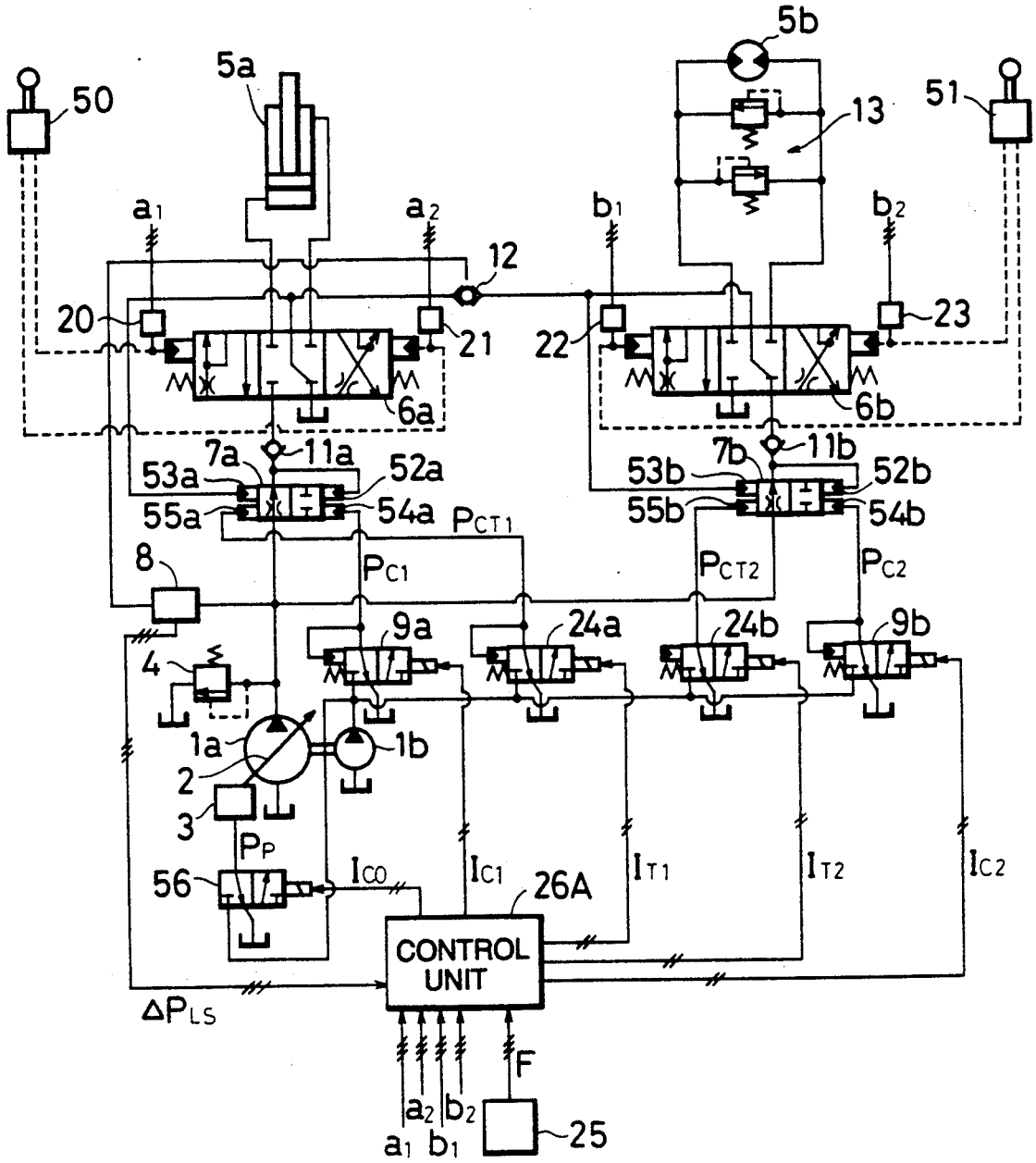
FIG. 7 is a block diagram of a hydraulic drive system for a construction machine according to a second embodiment of the present invention.

Another embodiment of the present invention will be described below with reference to FIG. 7. While the second control pressure introduced to the fourth pressure bearing chambers of the respective distribution compensating valves acting in the valve-opening direction is produced by the common solenoid proportional control valve in the above first embodiment, solenoid proportional control valves are provided in one-to-one relation to distribution compensating valves to individually set the differential pressure target values in this embodiment. In FIG. 7, identical members to those in FIG. 1 are denoted by the same reference numerals.

More specifically, as shown in FIG. 7, a hydraulic drive system of this embodiment comprises a solenoid proportional control valve 24*a* for producing a second control pressure $P_{CT1}$ introduced to the fourth pressure bearing chamber 55*a* of the first distribution compensating valve 7*a* acting in the valve-opening direction, and a solenoid control pressure $P_{CT2}$ introduced to the fourth pressure bearing chamber 55*b* of the first distribution compensating valve 7*b* acting in the valve-opening direction.

Also, a control unit 26A determines the operation states of the hydraulic cylinder 5*a* and the hydraulic motor 5*b* based on the operation signals $a_1$, $a_2$, $b_1$, $b_2$ from the operation sensors 20, 21, 22, 23, individually calculates the first target values $\Delta P_{T01}$, $\Delta P_{T02}$ of the differential pressures of the first and second flow control valves 6*a*, 6*b* from the operation states of the hydraulic cylinder 5*a* and the hydraulic motor 5*b*, determines the types of the hydraulic actuators 5*a*, 5*b* based on the actuator type signal F from the actuator type setter 25, modifies the first target values dependent on the determined types to individually derive the second target values $\Delta P_{T1}$, $\Delta P_{T2}$, and finally outputs the control currents $I_{T1}$, $I_{T2}$ corresponding to the second target values $\Delta P_{T1}$, $\Delta P_{T2}$ to the solenoid proportional control valves 24*a*, 24*b*, respectively.

With this embodiment, since the target values set by the fourth pressure bearing chambers 55*a*, 55*b* of the first and second distribution compensating valves 7*a*, 7*b* can be individually changed, the allowable maximum flow rates passing through the first and second flow control valves 6*a*, 6*b* can be set in an individual manner, for example, such that the distribution compensating valve associated with the hydraulic actuator having the standard capacity controls a maximum flow rate to the standard one and the distribution compensating valve associated with the hydraulic actuator having the capacity larger than standard controls a maximum flow rate to the value larger than standard. This enables a further improvement in the operability.

It is to be noted that while the above embodiments have been explained as changing the differential pressure target value dependent upon the types relating to capacity of the hydraulic actuator, there are often situations where the operator desires to intentionally change the maximum flow rate dependent upon the forms of work even with the hydraulic actuator being of the same capacity, and the present invention is applicable to such a case as well. This modified embodiment only requires it to provide a maximum flow rate setter similar to the aforesaid actuator type setter, and change the differential pressure target value in response to a signal from the maximum flow rate setter. As a result, the maximum driving speed of the actuator resulted when the control lever is maximally operated dependent upon the forms of work can be freely set for the improved efficiency of work.

Further, in the above embodiments, the separate solenoid proportional control valves 9*a*, 9*b* are provided in the third pressure bearing chambers 54*a*, 54*b* of the first and second distribution compensating valves 7*a*, 7*b* to individually produce the respective first control pressures introduced to those pressure bearing chambers. However, when the differential pressure target values of the two flow control valves may be reduced at the same proportion, it is possible to provide a single common solenoid proportional control valve and introduce the same first control pressure to both the third pressure bearing chambers.

It is a matter of course that while the type of the hydraulic actuator is determined after determining the operation states of the hydraulic actuators in the flowchart shown in FIG. 4, these two determining steps may be reversed in order.

For a particular hydraulic actuator, the differential pressure target value may be set by only setting of the actuator type setter regardless of the value detected by the aforesaid operation sensor. In this case, the control process can be simplified.

Also, in the above embodiment, when the amount of the hydraulic fluid supplied from the pump is insufficient, the differential pressure target value is reduced only by increasing the target reducing value which is set by the pressure bearing chamber acting in the valve-closing direction. However, such a reduction of the differential pressure target value is similarly enabled by reducing the differential pressure target value itself which is set by the pressure bearing chamber acting in the valve-opening direction. As an alternative, both the methods may be adopted together.

Additionally, in the case of driving an actuator subjected to an extremely high pressure load and an actuator subjected to an extremely low pressure load at the same time, it is possible to suppress the flow rate passing to the lower load side and permit a wider range of control by setting the target reducing value for the differential pressure, which is set by the pressure bearing chamber of the lower-load side distribution compensating valve acting in the valve-closing direction, to be larger than the differential pressure target value which is set by the pressure bearing chamber thereof acting in the valve-closing direction.

INDUSTRIAL APPLICABILITY

According to the present invention, as fully described above, a target value of a differential pressure across a flow control valve can be freely changed to enable change in an allowable maximum flow rate passing through the flow control valve, so that a maximum driving speed may be freely set dependent upon capacity of a hydraulic actuator used and/or the forms of work to be carried out.

I claim:

1. A hydraulic drive system for a construction machine comprising a hydraulic pump (1*a*); a plurality of hydraulic actuators (5*a*, 5*b*) driven by a hydraulic fluid delivered from said hydraulic fluid; a plurality of flow control valves (6*a*, 6*b*) for controlling respective flow rates of the hydraulic fluid supplied from said hydraulic pump to said hydraulic actuators dependent upon input amounts of manipulation means (50, 51); a plurality of distribution compensating valves (7*a*, 7*b*) for controlling respective differential pressures across said plurality of flow control valves, said distribution compensating valves (7*a*, 7*b*) respectively having first pressure bearing chambers (52*a*, 52*b*) subjected to pressures upstream of the associated flow control valves for acting in a valve-closing direction, second pressure bearing chambers (53*a*, 53*b*) subjected to pressures downstream of the associated flow control valves for acting in a valve-opening direction, and third pressure bearing chambers (54*a*, 54*b*) subjected to first control pressures ($P_{C1}$, $P_{C2}$) for acting in the valve-closing direction to reduce target values of the differential pressures across the associated flow control valves; differential pressure sensor means (8) for detecting a differential pressure between a pressure of the hydraulic fluid delivered from said hydraulic pump and a maximum load pressure among said plurality of hydraulic actuators; first proportional control valve means (9*a*, 9*b*) for producing said first control pressures ($P_{C1}$, $P_{C2}$) dependent upon first control currents ($I_{C1}$, $I_{C2}$); and first computing control means (26, 203, 218) for calculating at least one target reducing value ($\Delta P_{C1}$, $\Delta P_{C2}$) to reduce the target values of the differential pressures across said plurality of flow control valves based on a detected value ($\Delta P_{LS}$) of said differential pressure sensor means, and outputting the corresponding first control currents to said first proportional control valve means, wherein the hydraulic drive system further comprises:

(a) a fourth pressure bearing chamber (55*a*, 55*b*) provided in at least one of said plurality of distribution compensating valves (7*a*, 7*b*) and subjected to a second control pressure ($P_{CT}$) for acting in the valve-opening direction to set a target value ($\Delta P_T$) of the differential pressure across the associated flow control valve (6*a*, 6*b*);

(b) second proportional control valve mean (24) for producing said second control pressure ($P_{CT}$) dependent upon a second control current ($I_T$);

(c) signal generating means (25, 20–23) for outputting a signal (F, $a_1$, $a_2$, $b_1$, $b_2$) relating to the target value ($\Delta P_T$) of the differential pressure across the associated flow control valve (6*a*, 6*b*); and (d) second computing control means (26, 204–218) for calculating the target value ($\Delta P_T$) of the differential pressure across said associated flow control valve dependent upon the signal from said signal generating means, and outputting the corresponding second control current ($I_T$) to said second proportional control valve means (24).

2. A hydraulic drive system for a construction machine according to claim 1, wherein said signal generating means includes means (25) for setting the type relating to capacity of the hydraulic actuator (5*a*, 5*b*) associated with the distribution compensating valve (7*a*, 7*b*) having said fourth pressure bearing chamber (55*a*, 55*b*), and said second computing control means calculates said differential pressure target value ($\Delta P_T$) dependent upon a signal (F) from said setting means.

3. A hydraulic drive system for a construction machine according to claim 1, wherein said signal generating means includes operation sensor means (20–23) for detecting an operation state of the flow control valve (6*a*, 6*b*) associated with the distribution compensating valve (7*a*, 7*b*) having said fourth pressure bearing chamber (55*a*, 55*b*), and said second computing control means (26, 204–210) calculates said differential pressure target value ($\Delta P_T$) from a detected value ($a_1$, $a_2$, $b_1$, $b_2$) of said operation sensor means.

4. A hydraulic drive system for a construction machine according to claim 1, wherein said signal generating means includes means (25) for setting the type relating to capacity of the hydraulic actuator (5*a*, 5*b*) associated with the distribution compensating valve (7*a*, 7*b*) having said fourth pressure bearing chamber (55*a*, 55*b*), and operation sensor means (20–23) for detecting an operation state of the flow control valve (6*a*, 6*b*) associated with said distribution compensating valve, and said second computing control means calculates said differential pressure target value ($\Delta P_T$) dependent upon a signal (F) from said setting means and a detected value ($a_1$, $a_2$, $b_1$, $b_2$) of said operation sensor means.

5. A hydraulic drive system for a construction machine according to claim 1, wherein said fourth pressure bearing chamber (55*a*, 55*b*) is provided in each of said plurality of distribution compensating valves (7*a*, 7*b*), and said second proportional control valve means includes a common proportional control valve (24) connected to the respective fourth pressure bearing chambers of said plurality of distribution compensating valves.

6. A hydraulic drive system for a construction machine according to claim 1, wherein said fourth pressure bearing chamber (55*a*, 55*b*) is provided in each of said plurality of distribution compensating valves (7*a*, 7*b*), and said second proportional control valve means includes a plurality of proportional control valves (24*a*, 24*b*) individually connected to the respective fourth pressure bearing chambers of said plurality of distribution compensating valves.

7. A hydraulic drive system for a construction machine according to claim 1, wherein said second computing control means (26) includes means (26*c*) for storing at least two target values for each of the differential pressures across said associated flow control valves (6*a*, 6*b*) including normal target values ($\Delta P_{i1}$, $\Delta P_{i4}$) and target values ($\Delta P_{i2}$, $\Delta P_{i3}$) larger than said normal target values, means (204–210) for selecting one of said two target values dependent upon the signal ($a_1$, $a_2$, $b_1$, $b_2$) from said signal generating means (20–23), and means (218) for outputting said second control current ($I_T$) dependent upon the selected target value.

8. A hydraulic drive system for a construction machine according to claim 1, wherein said second computing control means (26) includes means (26*c*) for storing an initial value ($\Delta P_{T0}$) for the target values of the differential pressures across said associated flow control valves (6*a*, 6*b*) and at least two different modification values ($P_{S1}$–$P_{S4}$) to be added to said initial value, means (211–217) for selecting one of said two modification values dependent upon the signal (F) from said signal generating means (25) and adding the selected modification value to said initial value to calculate said target value ($\Delta P_T$), and means (218) for outputting said second control current ($I_T$) dependent upon the calculated target value.

* * * * *